US005601876A

United States Patent [19]

Oates et al.

[11] Patent Number: 5,601,876

[45] Date of Patent: Feb. 11, 1997

[54] WATER BASED CRACKLE FINISH AND A METHOD FOR APPLICATION THEREOF

[75] Inventors: Ryan C. Oates; Wade R. Potter; Brian Bottem; William A. Maligie, all of Chico; William F. Hagen, Paradise, all of Calif.

[73] Assignee: Alternative Materials Technology, Inc., Chico, Calif.

[21] Appl. No.: 168,766

[22] Filed: Dec. 15, 1993

[51] Int. Cl.[6] ..... B05D 5/02

[52] U.S. Cl. ..... 427/257; 427/262; 428/155

[58] Field of Search ..... 427/257, 258, 427/262; 428/155

[56] References Cited

U.S. PATENT DOCUMENTS 3,769,063 10/1973 Kizawa ..... 428/155

OTHER PUBLICATIONS

South Coast Air Quality Management District (SCAQMD), Rule 1136.

ANSI KCMA A161.1–1990, published by the Kitchen Cabinet Manufacturer Association.

Billmeyer, "Textbook of Polymer Science", 1962, p. 404.

*Primary Examiner*—Melvyn I. Marquis
*Assistant Examiner*—D. Aylward
*Attorney, Agent, or Firm*—Bernhard Kreten

[57] ABSTRACT

A water based crackle finish for surfaces includes a base coating having a low molecular weight polymer dissolved in an aqueous solution. Disposed on the dried base coating is a coating having an aqueous emulsion of a high molecular weight polymer which is dried. If desired, a stain coating, a sealer coating and a glaze coating and combinations thereof may be disposed on the surface under the base coating. Also, if desired, a fly-speck coating and a top coating may be applied over the crackle coating. A method of applying the coating is disclosed.

17 Claims, 2 Drawing Sheets

WATER BASED CRACKLE FINISH AND A METHOD FOR APPLICATION THEREOF

FIELD OF THE INVENTION

The present invention relates to a crackle finish for a surface and a method for applying the finish and more particularly, to an aqueous crackle finish which has minimal volatile organic compounds.

BACKGROUND ART

An increased consciousness towards maintaining a healthy environment necessitates a transition from volatile organic solvent based coating preparations to those of aqueous based systems. The obvious advantages of this are the alleviation of evaporation of large quantities of organic solvents into the environment and the minimization of problems associated with industrial worker exposure to organic solvents.

Since laws have been enacted (South Coast Air Quality Management District (SCAQMD) Rule 1136), this concept of minimization of volatile organic solvent use as a component, in coating preparations by using instead an aqueous based system has become of paramount importance as mandated minimization of volatile organic compounds (VOC) is realized. Another factor which makes adaptation to aqueous systems desirable is that the clean-up of water-borne systems does not require organic solvents. An economic benefit is also realized by eliminating the use of expensive organic solvents which are continually increasing in cost.

As an alternative to elimination of volatile organic solvents, U.S. Pat. No. 4,675,374, discloses the use of liquid components sufficiently low in viscosity to be mixed and applied to a surface, thus requiring no organic or aqueous carrier. This methodology may only have limited scope however, as many polymeric compositions consist of solids or highly viscous liquids which require a solvent system to allow for application.

The applicants are also aware of an increasing trend towards the use of aqueous systems as disclosed in U.S. Pat. Nos. 5,252,657; 4,814,373; 5,227,433; 5,093,405 issued to Frankel et al, U.S. Pat. Nos. 4,677,168; 5,039,759 issued to Hoy et al, U.S. Pat. No. 4,977,219 issued to Watson, Jr., U.S. Pat. No. 4,748,167 issued to Das et al.

The use of coatings is ubiquitous in man-made products and almost every man-made item has surface coating serving either a protective or a decorative role or possibly both. In the spirit of both the decorative and protective role of a coating, it is often desirable to provide a surface coat that has the appearance of a distressed, antique, or aged look, to be referred to as a crackle coat. In a direct parallel with the necessity to move from the volatile organic based solvent systems for coatings to an aqueous based system as previously discussed, coatings which provide this antique look, traditionally prepared in an organic solvent system also require changing to an aqueous based system for the previously stated reasons. While the above references give examples of aqueous based systems for coatings, thus eliminating or minimizing the volatile organic component of the systems, they do not address a decorative coating that provides the antique or crackle appearance. Further, examples of coatings which are prepared as aqueous systems, but do not include a decorative coating that provides the antique or crackle appearance are U.S. Pat. No. 4,196,107 to Jones et al, U.S. Pat. No. 4,292,220 to Novak et al and U.S. Pat. No. 4,276,329 to Vasisth et al. Therefore, there is a need for a coating and a method which is an aqueous based coating system that produces an antique or crackle appearance to the coating.

SUMMARY OF THE INVENTION

It is an object of the present invention to provide a crackle finish for a surface which uses aqueous based components and reduces the volatile organic compounds present during and after the application of the components.

It is a further object of the present invention to provide a method of applying the water based components to produce the crackle finish.

In accordance with the teachings of the present invention, there is disclosed a water based crackle finish for a surface comprising a base coating disposed on the surface. The base coating is a low molecular weight polymer, soluble in an aqueous solution. A crackle coating is disposed on the base coating. The crackle coating is an aqueous emulsion of a high molecular weight polymer.

In further accordance with the teachings of the present invention, there is disclosed a crackle finish for surfaces including a stain coating disposed on the surface, a sealer coating disposed on the stain coating, and a base coating disposed on the sealer coating. The base coating is a low molecular weight polymer water soluble in an aqueous solution. A crackle coating is disposed on the base coating. The crackle coating is an aqueous emulsion of a high molecular weight polymer. A fly-speck coating is disposed on the crackle coating. A top coating is disposed on the crackle coating. The top coating is a water based polymeric emulsion. The presence of organic compounds is minimized.

In still further accordance with the teachings of the present invention, there is disclosed a method of forming a crackle finish on a surface including the steps of applying a stain coating to the surface, and of drying the stain coating. A sealer coating is applied to the dried stain coating, and the sealer coating is dried. A glaze coating is applied to the sealer coating and the glaze coating is dried. An aqueous base coating is applied to the dried sealer coating. The aqueous base coating is a low molecular weight polymer water soluble in an aqueous solution. The base coating is dried. A crackle coating is applied to the dried base coating. The crackle coating is an aqueous emulsion of a high molecular weight polymer. The crackle coating is dried. A fly-speck coating is applied to the crackle coating and dried. A top coating is applied to the dried crackle coating. The top coating is a water based polymeric emulsion. The top coating is dried.

These and other objects of the present invention will become apparent from a reading of the following specification, taken in conjunction with the enclosed drawings.

DESCRIPTION OF THE PREFERRED EMBODIMENTS

Figure 1:
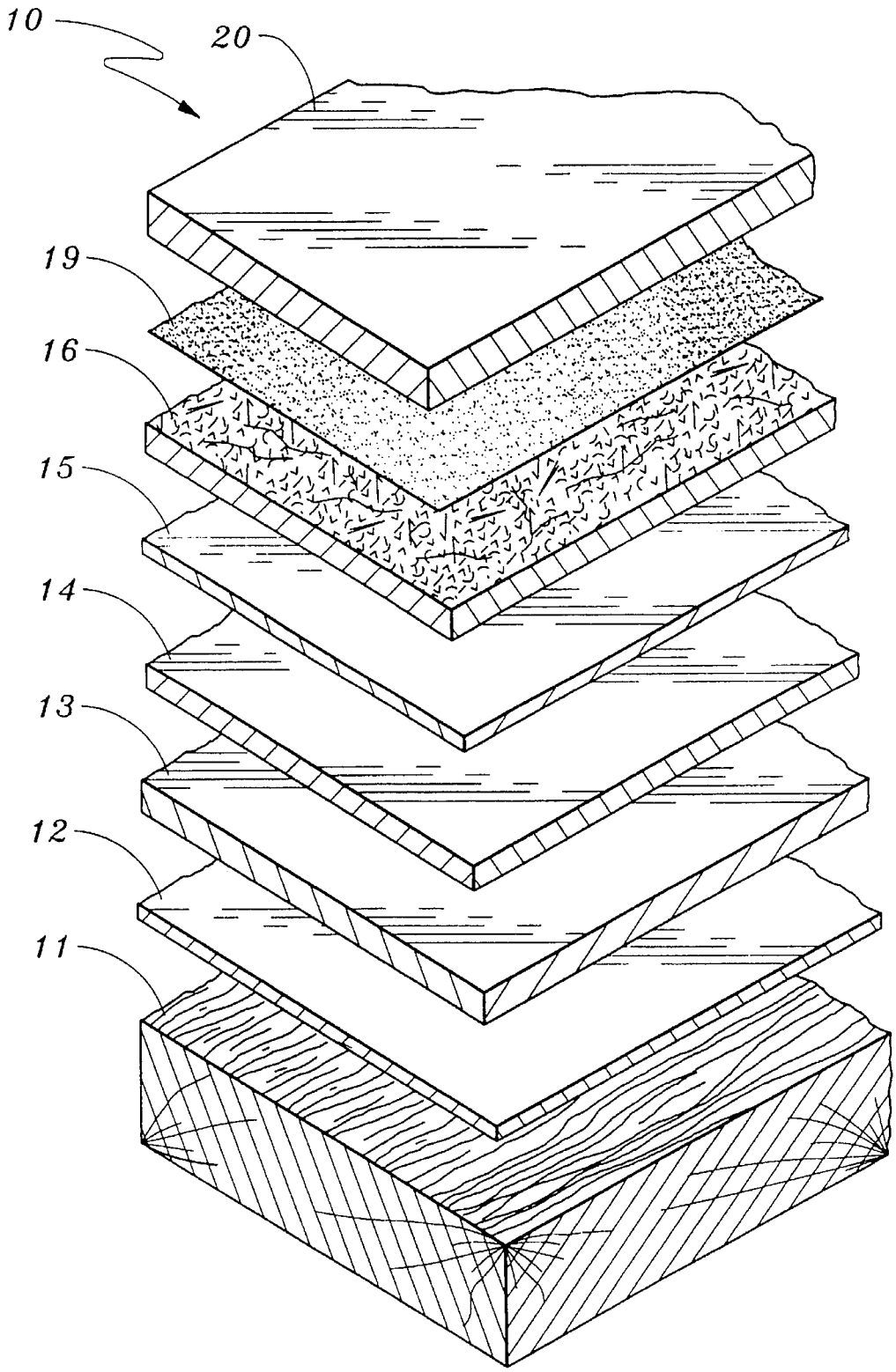
FIG. 1 is a partial cutaway view showing the plurality of coatings of the present invention disposed on a surface.
Figure 2:
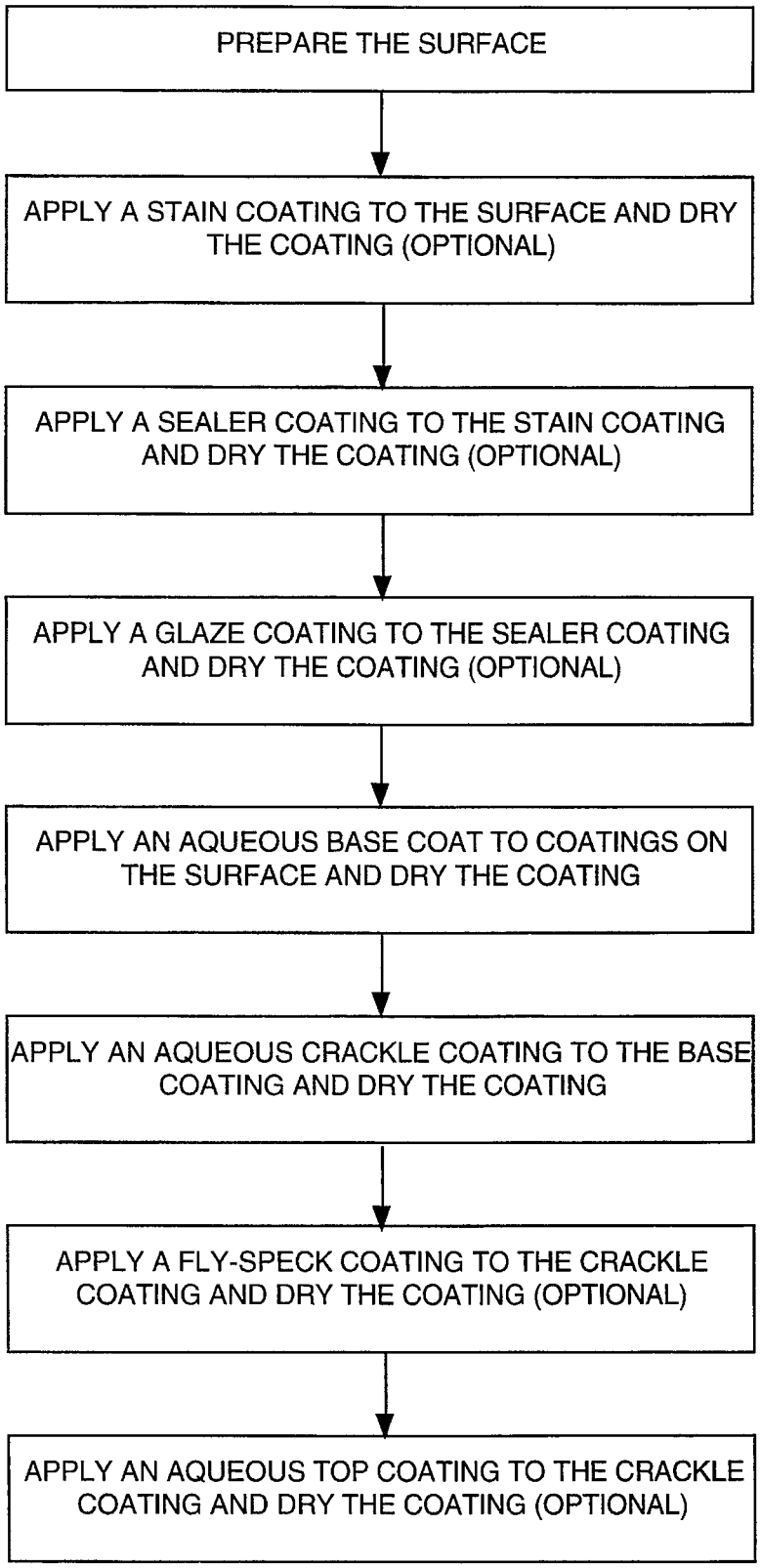
FIG. 2 is a diagram of the steps in the method of forming the finish of the present invention.

The present invention consists of an aqueous crackle finish 10 having both protective and decorative properties. The decorative properties pertain to an appearance of an antique or distressed look obtained with multiple coatings which are applied to a surface 11. The crackle finish 10 may be applied to any surface 11 but is preferably used on a wood surface 11. The wood surface 11 is prepared by a sanding or other treatment to provide a smooth surface.

Depending upon the nature of the wood including the grain and the type of wood (e.g., pine, oak, walnut, etc.) a stain coating 12 may be applied to the surface 11 to produce a desired appearance. Preferably, the stain coating 12 is aqueous based but the present invention is not so limited and a solvent based stain coating 12 may be used. The stain coating 12 is dried.

If it is desired to seal the wood surface 11, a sealer coating 13 may be applied. The sealer coating 13 keeps subsequent coatings from entering or bleeding into the wood surface 11. The sealer coating 13 may be applied directly to the wood surface 11, or if the wood surface has a stain coating 12, the sealer coating 13 is applied to the stain coating. The sealer coating 13 is preferably an aqueous based polymer formulation, but a solvent based coating may be used. The sealer coating 13 is dried.

For aesthetic purposes, it may be desirable to apply an aqueous glaze coating 14 to the surface 11, or to the stain coating 12 or sealer coating 13, if either or both of the latter coatings are present. The glaze coating 14 is dried.

The next coating is a base coating 15 consisting of a water soluble low molecular weight polymer in an aqueous solution. Alternately, the polymer may be a water insoluble low molecular weight polymer in an aqueous emulsion. This polymer can include, but is not limited to polyvinyl alcohol, alkali soluble acrylates, polyvinyl acetates, nitrocellulose, alkyds, and polyesters with a molecular weight ranging from 10,000 to 300,000. The concentration of the polymer in the aqueous solution can range from 5% to 80% by weight. A preferred concentration is 22% by weight. In addition to the water soluble polymer, the surface tension difference of this base coating 15 and the subsequent crackle coating 16 can be increased by including a surface tension reducing additive. The surface tension reducing additive is in a concentration range of 0.1%–5% by weight, depending upon the additive. The concentration is not critical. Examples of surface tension reducing additives include, but are not limited to, acetylenic alcohols, silicone fluids, polysiloxane solutions, glycol ethers, etc. Depending on the minimum film forming temperature of the low molecular weight polymer solution, an appropriate water soluble coalescent solvent may be required consisting of glycol ethers, texanol, and similar materials. The base coating 15 is dried after application. The base coating 15 is applied to the glaze coating 14, the sealer coating 13, the stain coating 12 or directly on the surface 11 depending upon the use intended and the extent of the coatings disposed on the surface 11 prior to applying the base coating 15. The base coating 15 is applied to the last of the selected undercoatings.

Disposed on the base coating 15 is a crackle coating 16. The crackle coating 16 is composed of an aqueous emulsion of a high molecular weight polymer in the range of, but not limited to, 100,000 to 5,000,000 with the preferred molecular weight being approximately 1,000,000. This polymer can include, but is not limited to, urethanes, polyvinyl alcohols, styrene-acrylics, nitrocellulose, acrylics, and acrylonitriles. Typical ranges for the solids content range from 5% to 80% by weight, with the preferred being 34%. Suitable water soluble coalescent solvents are required to provide adequate film formation and include ethylene and propylene based glycol ethers, ester-alcohols (i.e., texanol), N-methyl pyrrolidone, and others in the range of 3%–45%. Various plasticizers can also be incorporated into the formulation in the range of 0.10% to 50.0% by weight, with the preferred being 1.2%, and can include dibutyl phthalate, dioctyl phthalate, and similar esters. This crackle coating 16 can be colorless or be colored by the inclusion of suitable dyes or pigments to give the desired shade and color. The rheological properties of the crackle coating 16 can be controlled with suitable additives such as urethanes, inorganic salts of polycarboxylic acids, hydroxy ethyl cellulose, and similar materials. In some cases, it may be necessary to include silica fillers either organically treated or untreated. The crackle coating 16 is dried.

If desired, an aqueous fly-speck coating 19 may be disposed on the crackle coating 16. The coating is a random pattern of spots of colored material which is applied to the crackle coating 19.

The final coating, if desired, is a top coating 20 that protects all of the underlying coatings, as well as the surface. The top coating 20 consists of an appropriate water based polymeric emulsion, suitable coalescing solvents, wetting agents, flatting agents, dispersing agents, plasticizers, rheological control agents, pH adjusters, and anti-mar/scratch resistant additives. These agents and additives are known to persons skilled in the art. The top coating 20 is dried.

The drying of all of the coatings is preferably at 70° F. and 50% relative humidity conditions for a period of approximately 7 to 15 minutes.

Application of these coats can be done by, but is not limited to brushing, rolling, or spraying, using conventional spraying equipment and/or equipment modified to handle aqueous systems.

The scope of the invention is in no way limited by the examples given below. The crackle finish includes sequential deposition of at least a base coating 15 under a crackle coating 16. It may include any combination of a stain coating 12, a sanding sealer coating 13, and a glaze coating 15 disposed on the surface prior to deposition of the base coating 15. The base coating 15 consisting of:

| | |
|---|---|
| Acrylic emulsion, 40% solids | 55,00%* |
| Aqueous ammonia (26 baume, 29%) | 3.00% |
| Ethylene glycol monobutyl ether | 2.00% |
| Surfactant | 0.50% |
| Water | 33.50% |
| Isopropanol | 6.00% |

| | |
|---|---|
| Polyvinyl acetate | 65.00%* |
| Surfactant | 0.50% |
| Ethylene glycol monobutyl ether | 2.00% |
| Water | 32.50% |

| | |
|---|---|
| Polyvinyl alcohol | 20.00%* |
| Wetting agent | 0.40% |
| Isopropanol | 5.00% |
| Water | 74.60% |

| | |
|---|---|
| Styrene/acrylic copolymer emulsion | 70.00%* |
| Ethylene glycol monobutyl ether | 8.00% |
| Diethylene glycol monobutyl ether | 2.00% |
| 2,2,4-Trimethyl-1,3-pentanediol-monoisobutyrate | 1.00% |

-continued

| | |
|---|---|
| Dibutyl phthalate | 2.00% |
| Carbon black dispersion | 0.05% |
| Water | 16.50% |

| | |
|---|---|
| Acrylic copolymer emulsion, 40% solids | 72.50%* |
| Ethylene glycol monobutyl ether | 6.00% |
| Diethylene glycol monopropyl ether | 3.00% |
| Carbon black dispersion | 0.05% |
| Water | 18.45% |

| | |
|---|---|
| Acrylic copolymer emulsion, 45% solids | 65.00%* |
| Ethylene glycolmonobutyl ether | 8.00% |
| Diethylene glycolmonobutyl ether | 2.00% |
| Dibutyl phthalate | 1.00% |
| Carbon black dispersion | 0.05% |
| Water | 23.95% |

*Percentages are by wieght.

After deposition of the crackle coating 16, the finish may further have, if desired, a fly speck coating 19 and a top coating 20.

The crackle coating 16 is prepared as follows: The water, surfactant, ethylene glycol monobutyl ether, diethylene glycol monobutyl ether, and dibutyl phthalate were premixed with stirring. The resulting solution was then added to the stirring acrylic copolymer emulsion. The carbon black dispersion was then added, and the resulting material was then stirred to obtain a uniform mixture.

A prime factor is the application of a suitable coating to a water soluble resin base coating 15 wherein that suitable coat will crackle. Normally, when a coating is applied to a base coat, the freshly applied coating dries as the water and coalescents evaporate out primarily through the surface of the coating. However, when the crackle coating 16 is applied to the water soluble base coating 15, the water and coalescing agents in the crackle coating 16 are absorbed through the base coating 15 in addition to the normal evaporative route through the top surface of the crackle coating 16. This dual evaporative mechanism then causes rapid shrinkage of the crackle coating 16. The crackle coating 16 "skins over" or solidifies on the surface of the crackle coating 16 due to the increased loss of liquid through the base coating 15. The resulting effect of this shrinkage is a cracking of the crackle coating 16, which consists of, or is made up of raised islands or domains separated by cracks or valleys.

Surface tension differences exist between the base coat film and the crackle coat liquid. The difference in the surface tension between the base coating 15 and the crackle coating 16 can be controlled or increased by, but is not limited to, including a surface tension reducer in the base coating 15, e.g., a polysiloxane wetting agent and not including such an additive in the crackle coating 16. This difference further enhances the mobility of the crackle coating 16 as it pulls apart and forms the cracks. The critical events that are controlled are the size and the extent of the cracking, as well as the type of cracked edges formed.

Thus the antique look of the crackle finish 10 is obtained through a seven-step coating process that consists of an initial preparation of the surface 11 such as sanding. This is followed by, up to but not limited to, seven aqueous based coatings. The coatings can consist of (1) an initial stain coating 12 followed by (2) a sanding sealer coating 15 and (3) glaze coating 16. A (4) base coating 15 is then applied, followed by (5) the crackle coating 16. The (6) fly-speck coating 19 is applied, followed by (7) the top coating 20. Some or all of these steps may be optional, such as the initial stain, the sanding sealer, the fly specking, and the top coat, depending on the overall look color, and degree of protection desired. A drying step is included after each application step.

In this manner, an aqueous coating is disclosed which provides a crackle finish to a surface. The water based coating of the present invention produces volatile organic compounds in the range of 0.1 to 0.9 lbs. per gallon which is the total emission released into the atmosphere when one gallon of product is sprayed. As opposed to the water based coating, a typical solvent based coating produces approximately 4 to 7 lbs. per gallon. Thus, the volatile organic compounds produced by the aqueous coating of the present invention are minimal and the working environment is significantly improved over the use of prior art coatings.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A water based crackle finish for a surface comprising a base coating disposed on the surface, the base coating being a water soluble low molecular weight polymer, a crackle coating disposed on the base coating, the crackle coating being an aqueous emulsion of a high molecular weight polymer.

2. The water based crackle finish of claim 1, wherein in the base coating, the water soluble polymer is selected from the group consisting of polyvinyl alcohols, alkali soluble acrylates, polyvinyl acetates, nitrocellulose, alkyds and polyesters.

3. The water based crackle finish of claim 1, wherein in the base coating, the concentration of the polymer in the aqueous solution ranges from 5% to 80% by weight.

4. The water based crackle finish of claim 3, wherein the concentration of the polymer in the aqueous solution is 22% by weight.

5. The water based crackle finish of claim 1, further comprising a surface tension reducing additive added to the base coating.

6. The water based crackle finish of claim 1, further comprising a water soluble coalescent solvent added to the base coating.

7. The water based crackle finish of claim 1, wherein the polymer in the crackle coating has a molecular weight in the range of 100,000 to 5,000,000.

8. The water based crackle finish of claim 1, wherein in the crackle coating, the high molecular weight polymer is selected from the group consisting of urethanes, polyvinyl alcohols, styrene-acrylics, nitrocellulose, acrylics, and acrylonitriles.

9. The water based crackle finish of claim 1, the crackle coating having solids therein, the solids ranging from 5% to 80% by weight.

10. The water based crackle finish of claim 9, wherein the solids range from 25% to 40% by weight.

11. The water based crackle finish of claim 1, the crackle coating further comprising a water soluble coalescent solvent added to the crackle coating.

12. The water based crackle finish of claim 11, wherein the coalescent solvent is in the range of 3% to 45% by weight.

13. The water based crackle finish of claim 11, wherein the coalescent solvent is selected from the group consisting of ethylene based glycol ethers, propylene based glycol ethers, ester-alcohols and N-methyl pyrrolidone.

14. The water based crackle finish of claim 1, the crackle coating further comprising a plasticizer added to the crackle coating.

15. The water based crackle finish of claim 1, wherein the volatile organic compounds are approximately 0.1 to 0.9 lbs. per gallon of finish.

16. A method of forming a crackle finish on a surface comprising the steps of applying an aqueous base coating to the surface, the base coating being a water soluble polymer in an aqueous solution, drying the base coating, applying a crackle coating to the dried base coating, the crackle coating being an aqueous emulsion of a high molecular weight polymer and drying the crackle coating.

17. The method of claim 16, wherein the base coating and the crackle coating each dry in approximately 7 minutes to 15 minutes.

* * * * *